US012157042B2

(12) United States Patent
Park

(10) Patent No.: US 12,157,042 B2
(45) Date of Patent: Dec. 3, 2024

(54) PUTTER STAND

(71) Applicant: Chung-Yeul Park, Yongin-si (KR)

(72) Inventor: Chung-Yeul Park, Yongin-si (KR)

( * ) Notice: Subject to any disclaimer, the term of this patent is extended or adjusted under 35 U.S.C. 154(b) by 0 days.

(21) Appl. No.: 18/222,007

(22) Filed: Jul. 14, 2023

(65) Prior Publication Data

US 2024/0189677 A1 Jun. 13, 2024

(30) Foreign Application Priority Data

Dec. 8, 2022 (KR) ..... 10-2022-0170511

(51) Int. Cl.
*A63B 55/10* (2006.01)
*A63B 55/20* (2015.01)

(52) U.S. Cl.
CPC ..... *A63B 55/10* (2013.01); *A63B 55/20* (2015.10)

(58) Field of Classification Search
CPC ..... A63B 55/10; A63B 55/20; A63B 55/50; A47B 81/00; A47B 81/005
USPC ..... 211/70.2
See application file for complete search history.

(56) References Cited

U.S. PATENT DOCUMENTS 1,823,729 A * 9/1931 De Bussey ..... A24F 9/14 131/257
5,152,524 A * 10/1992 Brown ..... A63B 57/00 473/285
5,413,329 A * 5/1995 Hirsch ..... A63B 55/10 473/282
5,437,449 A * 8/1995 Zink ..... A63B 55/10 473/286
5,492,230 A * 2/1996 Horton ..... A63B 55/10 473/282
5,529,299 A * 6/1996 Bellagamba ..... A63B 57/20 473/285
5,730,404 A * 3/1998 Evans ..... A63B 55/10 473/282
5,782,443 A * 7/1998 La Fontaine ..... A63B 55/10 473/282
5,853,336 A * 12/1998 Hufgard ..... A63B 55/10 473/285
6,234,916 B1 * 5/2001 Carusillo ..... A63B 55/10 473/286
6,283,875 B1 * 9/2001 Jones ..... A63B 55/10 248/688
6,309,308 B1 * 10/2001 Bennett ..... A63B 55/10 248/688
6,964,618 B2 * 11/2005 Klein ..... A63B 55/10 473/282

(Continued)

FOREIGN PATENT DOCUMENTS

GB 2459522 A * 10/2009 ..... A63B 55/10
GB 2485841 A * 5/2012 ..... A63B 55/10

(Continued)

*Primary Examiner* — Stanton L Krycinski

(57) ABSTRACT

Provided is a putter cradle including: a base plate 10 that attaches firmly to a ground surface, on a top side of which a putter head 7*a* of a putter 7 is placed; an upward extension 20, one end of which is connected to one side of the base plate, and the other end of which extends at an angle toward the base plate; and a shaft holder 30, one end of which is connected to an upper end of the upward extension, and which has a mounting groove at the other end where a putter shaft of the putter is mounted.

9 Claims, 7 Drawing Sheets

(56) References Cited

U.S. PATENT DOCUMENTS

| | | | | |
|---|---|---|---|---|
| 7,771,287 | B2 * | 8/2010 | Staszak | A63B 55/10 473/282 |
| 7,841,951 | B1 * | 11/2010 | Schiltz | A63B 55/10 473/282 |
| 7,850,550 | B2 * | 12/2010 | Nania | A63B 57/15 473/386 |
| 8,512,163 | B2 * | 8/2013 | McDowell | A63B 55/10 473/285 |
| 11,097,170 | B1 * | 8/2021 | Owens | A63B 55/10 |
| 11,179,612 | B2 * | 11/2021 | Nappe | F16M 13/06 |
| 2006/0163893 | A1 * | 7/2006 | Gascoigne | A63B 55/10 294/143 |
| 2006/0178225 | A1 * | 8/2006 | Hall | A63B 55/10 473/282 |
| 2007/0202960 | A1 * | 8/2007 | Flanagan | A63B 55/10 473/282 |
| 2007/0202961 | A1 * | 8/2007 | Andren | A63B 55/10 473/282 |
| 2008/0156753 | A1 * | 7/2008 | Perry | A63D 15/10 211/68 |
| 2008/0261713 | A1 * | 10/2008 | Schmitt | A63B 55/10 473/282 |

FOREIGN PATENT DOCUMENTS

| | | | | |
|---|---|---|---|---|
| GB | 2519585 | A * | 4/2015 | A63B 55/10 |
| JP | 3148998 | B | 3/2009 | |
| KR | 20130003735 | U * | 6/2013 | |

* cited by examiner

PUTTER STAND

CROSS-REFERENCES TO RELATED APPLICATION

The present application claims priority under 35 U.S.C. § 119(a) to Korean application number 10-2022-0170511, filed on Dec. 8, 2022, which is incorporated herein by reference in its entirety.

BACKGROUND

Technical Field

The present disclosure relates to a putter cradle for placing a putter.

Related Art

Most of the times, when golfers when practicing shots in a golf practice range, they change their golf clubs by pulling them from their golf bag (caddie bag) and leaving them propped up against a wall or the golf bag for a while, rather than keeping them in the bag.

Golfers will be spared the trouble of having to replace their golf clubs if they do a practice or play a game with the golf clubs propped up against a wall or their golf bag, but the golf clubs themselves may stand in the way of people passing by. Besides, if a golf club propped up temporarily collapses to the ground, the striking face of the club head may be damaged.

Also, any damage to the striking face of the golf club head may lead to poor performance in actual games. Since golfers are very sensitive when it comes to the heads of their golf clubs, many golf practice ranges are equipped with golf club stands used to support golf clubs with the club heads pointing upwards, in order to protect the heads of the golf clubs.

These golf club stands capable of supporting golf clubs with the club heads facing up in the air have a lesser chance of causing the golf clubs to fall over than just propping them up against a wall or a golf bag for a while, and thus can keep the golf clubs rather secure in place. However, most of these conventional golf club stands need to be fixed to a chair, wall, or the like and are quite bulky, making it impossible for golfers to carry them around themselves in the first place, and also they are not easy to move from place to place.

Particularly in the case of putters, propping them up against a wall is not a secure way to keep them in place because of their short lengths, and, moreover, they are not easy to hold in place even on traditional club stands.

SUMMARY

Technical Problem

The present disclosure is directed to solving these problems and providing a putter cradle where a putter is secured in place, and that offers easy portability.

Solution to Problem

An embodiment of the present disclosure provides a putter cradle including: a base plate that attaches firmly to a ground surface, on a top side of which a putter head of a putter is placed; an upward extension, one end of which is connected to one side of the base plate, and the other end of which extends at an angle toward the base plate; and a shaft holder, one end of which is connected to an upper end of the upward extension, and which has a mounting groove at the other end where a putter shaft of the putter is mounted.

Furthermore, in the putter cradle according to an embodiment of the present disclosure, a head mounting pad may be provided on an upper surface of the base plate, for mounting the putter head thereon.

Furthermore, in the putter cradle according to an embodiment of the present disclosure, a sloping mounting surface may be formed on a top side of the head mounting pad, and a slip-off prevention wall may be formed on one side of the head mounting pad, for preventing the putter head mounted on the mounting surface of the head mounting pad from slipping off the head mounting pad.

Furthermore, in the putter cradle according to an embodiment of the present disclosure, the mounting groove at the top and the slip-off prevention wall at the bottom may face each other at a predetermined distance, and the mounting groove may be positioned behind the slip-off prevention wall, whereby the putter shaft may be tilted into place while the putter head is stuck against the slip-off prevention wall.

Furthermore, in the putter cradle according to an embodiment of the present disclosure, the sloping mounting surface may have a sloping structure that slopes upward as the sloping mounting surface goes backward from the slip-off prevention wall toward the mounting groove.

Furthermore, in the putter cradle according to an embodiment of the present disclosure, the slip-off prevention wall may include a sloped surface cut portion which is formed by cutting the surfaces of upper corners of a front edge of the slip-off prevention wall.

Furthermore, in the putter cradle according to an embodiment of the present disclosure, the upward extension may have a forward sloping plate structure that is tilted forward toward the slip-off prevention wall.

Furthermore, in the putter cradle according to an embodiment of the present disclosure, a curved portion rounded in an arc shape may be formed at a connecting region where the base plate and the upward extension are connected.

Furthermore, in the putter cradle according to an embodiment of the present disclosure, a ball stop slit may be formed at one part of the curved portion, for restraining movement while a golf ball is placed thereon.

Furthermore, in the putter cradle according to an embodiment of the present disclosure, the ball stop slit may have a through-hole structure which is bored through one side of the curved portion behind the head mounting pad so that part of the outer circumference of the golf ball juts out backward from the curved portion and gets stuck in the ball stop slit.

Furthermore, in the putter cradle according to an embodiment of the present disclosure, the shaft holder may have a sloping structure that slopes upward and forward as the shaft holder goes from bottom to top, and the mounting groove may be formed on an upper end thereof.

Furthermore, in the putter cradle according to an embodiment of the present disclosure, the mounting groove may have a V-shaped structure with a wide entrance and a narrow inner bottom portion.

Furthermore, in the putter cradle according to an embodiment of the present disclosure, a cushion pad for covering the inner bottom portion may be provided on one side of the shaft holder in order to prevent the putter shaft inserted to the inner bottom portion of the mounting groove from coming into direct contact with the inner bottom portion.

Furthermore, in the putter cradle according to an embodiment of the present disclosure, the cushion pad may be disposed on a top side of the shaft holder, and an auxiliary cushion pad having an identical structure to the cushion pad may be provided on the underside of the shaft holder which corresponds in position to the top side of the shaft holder.

Furthermore, in the putter cradle according to an embodiment of the present disclosure, a plurality of elasticity-generating grooves may be formed on one side surface of the curved portion to make the upward extension move elastically with respect to the base plate.

Furthermore, in the putter cradle according to an embodiment of the present disclosure, the elasticity-generating grooves may have an indentation structure which is indented along a transverse direction of the curved portion.

Furthermore, in the putter cradle according to an embodiment of the present disclosure, the elasticity-generating grooves may be spaced out at predetermined intervals in a vertical direction of the curved portion.

Furthermore, in the putter cradle according to an embodiment of the present disclosure, an auxiliary curved portion rounded in an arc shape may be formed at a connecting region where the upward extension and the shaft holder are connected.

Furthermore, in the putter cradle according to an embodiment of the present disclosure, a plurality of elasticity-generating grooves may be formed on one side surface of the auxiliary curved portion to make the shaft holder move elastically with respect to the upward extension.

Furthermore, in the putter cradle according to an embodiment of the present disclosure, the elasticity-generating grooves may have an indentation structure which is indented along a transverse direction of the auxiliary curved portion.

Furthermore, in the putter cradle according to an embodiment of the present disclosure, the elasticity-generating grooves may be spaced out at predetermined intervals in a vertical direction of the auxiliary curved portion.

Furthermore, in the putter cradle according to an embodiment of the present disclosure, a plurality of putter head mounting protrusions may be formed on a top side of the sloping mounting surface of the head mounting pad, which extend longitudinally in a front-back direction of the head mounting pad and protrude upward, spaced out at predetermined intervals in a width direction of the head mounting pad, in order to keep the golf ball from slipping off to the side of the head mounting pad.

Advantageous Effects of Invention

As described above, the putter cradle according to an embodiment of the present disclosure can keep a putter secure in place during breaks between putting practice rounds. Therefore, the putter is kept from getting damaged, and can be easily and conveniently moved to a desired location and, as a result, the putter can be secured in place in the desired location, which makes this putter cradle more competitive.

BRIEF DESCRIPTION OF THE DRAWINGS

The accompanying drawings included as part of the detailed description in order to help understanding of the present disclosure provide embodiments of the present disclosure, and describe the technical spirit of the present disclosure along with the detailed description.

DETAILED DESCRIPTION OF EMBODIMENTS

Figure 1:
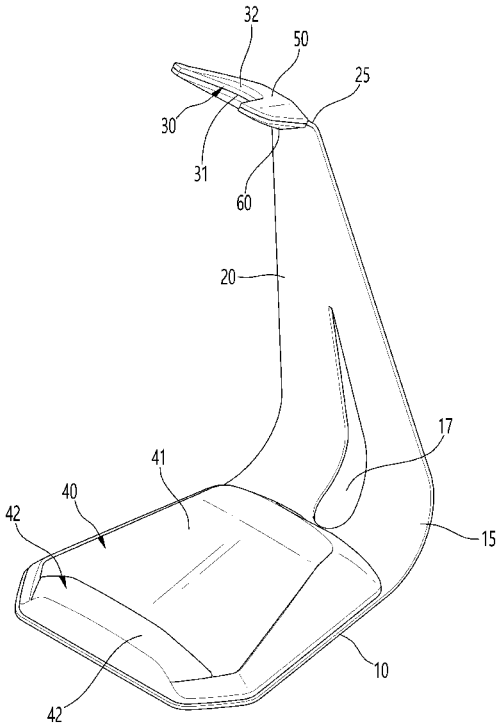
FIG. 1 is a front perspective view of a putter cradle as viewed from the front according to an embodiment of the present disclosure.
Figure 2:
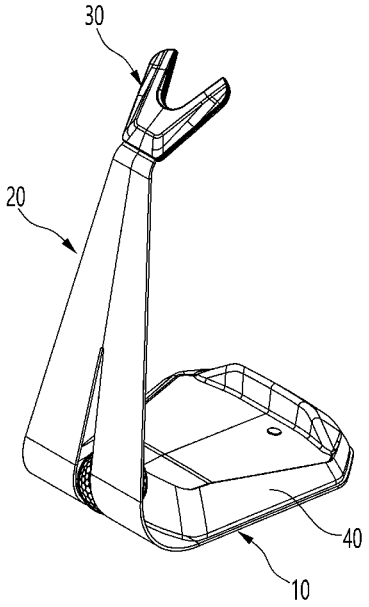
FIG. 2 is a rear perspective view of a putter cradle as viewed from the rear according to an embodiment of the present disclosure.
Figure 3:
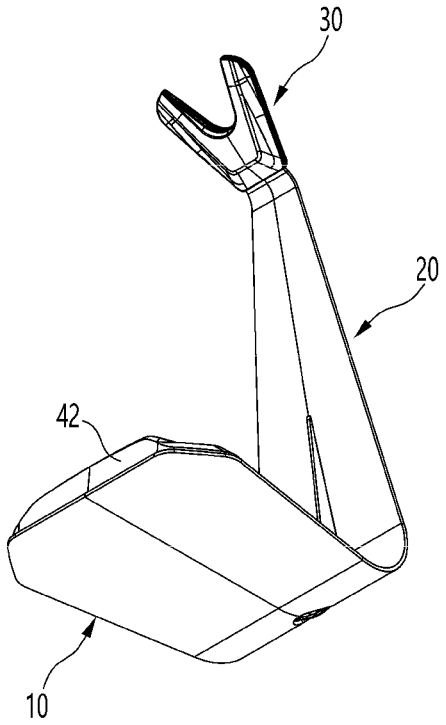
FIG. 3 is a bottom perspective view of a putter cradle as viewed from the bottom according to an embodiment of the present disclosure.
Figure 4:
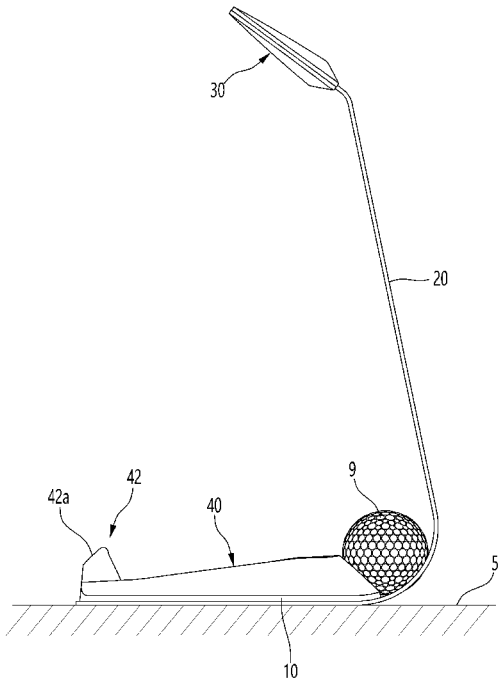
FIG. 4 is a side view of a putter cradle placed on a ground surface according to an embodiment of the present disclosure.
Figure 5:
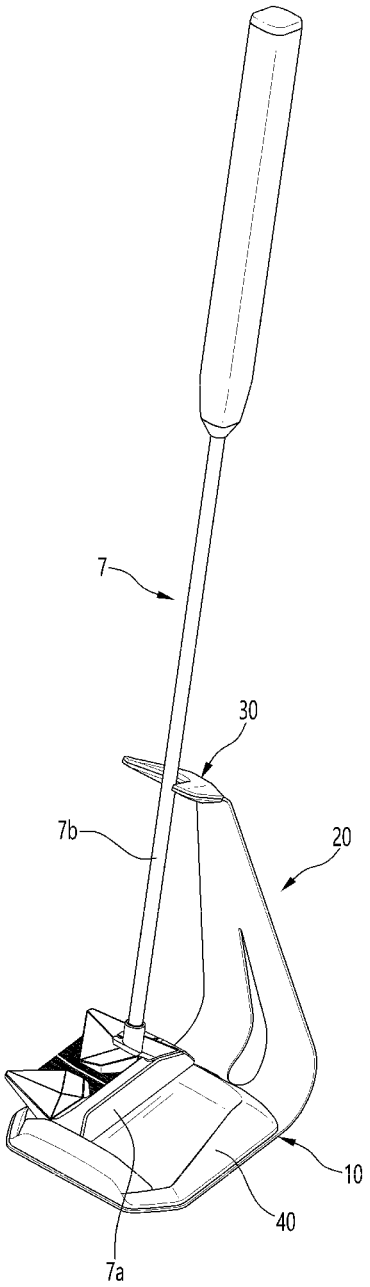
FIG. 5 is a schematic view of a putter held in place on a putter cradle according to an embodiment of the present disclosure.

Hereinafter, the present disclosure will be described below with reference to the accompanying drawings.

As depicted in FIGS. 1 to 5, a putter cradle according to an embodiment of the present disclosure includes a base plate 10, an upward extension 20, and a shaft holder 30.

The base plate 10 has a flat-plate structure that attaches firmly to a ground surface 5, such as of a practice range, on a top side of which a putter head 7*a* of a putter 7 is placed.

The upward extension 20 is in the shape of a plate, one end of which is connected to one side of the base plate 10 and the other end of which extends upward, and functions as a main body for supporting the putter 7.

The shaft holder 30 is connected to an upper end of the upward extension 20 at one end, and has a mounting groove 31 at the other end where a putter shaft 7*b* of the putter 7 is mounted.

Moreover, a head mounting pad 40 is provided on an upper surface of the base plate 10, which has a polygonal sloping block structure for mounting the putter head 7*a* on it.

Furthermore, a slip-off prevention wall 42 is formed on a front edge of the head mounting pad 40, for preventing the putter head 7*a* mounted on a mounting surface 41 of the head mounting pad 40 from slipping off the front of the head mounting pad 40.

Meanwhile, the putter cradle of the present disclosure is designed in such a way that the mounting groove 31 at the top and the slip-off prevention wall 42 at the bottom face each other at a predetermined distance, and that the mounting groove 31 is positioned behind the slip-off prevention wall 42, whereby the putter shaft 7*b* is tilted into place while the putter head 7*a* is stuck against the slip-off prevention wall 42.

Also, the mounting surface 41 has a sloping structure that slopes upward as it goes backward from the slip-off prevention wall 42 toward the mounting groove 31, which allows the putter head 7*a* placed on the mounting surface 41 to slide naturally along the sloping surface and reach the slip-off prevention wall 42.

Furthermore, the slip-off prevention wall 42 includes a sloped surface cut portion 42*a* which is formed by cutting the surfaces of upper corners of a front edge of the slip-off prevention wall 42 in order to alleviate impact from hitting.

The upward extension 20 has a forward sloping plate structure that is tilted forward toward the slip-off prevention wall 42.

Furthermore, a curved portion 15 rounded in an arc shape is formed at a connecting region where the base plate 10 and the upward extension 20 are connected.

In addition, a ball stop slit 17 is formed at one part of the curved portion 15, for restraining movement while a golf ball 9 is placed thereon.

Here, the ball stop slit 17 has a through-hole structure which is bored through one side of the curved portion 15 behind the head mounting pad 40 so that part of the outer circumference of the golf ball juts out backward from the curved portion 15 and gets stuck on the ball stop slit 17.

The shaft holder 30 has a sloping structure that slopes upward and forward as it goes from bottom to top, and the mounting groove 31 is formed on an upper end thereof.

Here, the mounting groove 31 has a V-shaped structure with a wide entrance and a narrow inner bottom portion 32 to make it easier to put the putter shaft 7*b* inside the mounting groove 31.

Furthermore, the shaft holder 30 has a cushion pad 50 made of a flexible material (rubber, silicon, etc.) which covers a front face of the inner bottom portion 32 in order to prevent the putter shaft 7*b* inserted to the inner bottom portion 32 of the mounting groove 31 from getting damaged due to direct contact with the inner bottom portion 32.

Additionally, the cushion pad 50 is disposed on a top side of the shaft holder 30, and an auxiliary cushion pad 60 having an identical structure to the cushion pad 50 is provided on the underside of the shaft holder 30 which corresponds in position to the top side of the shaft holder 30. Thus, the auxiliary cushion pad 60 may serve as a handle, for example, which the user can use when moving around holding the putter cradle of the present disclosure with hands.

Figure 6:
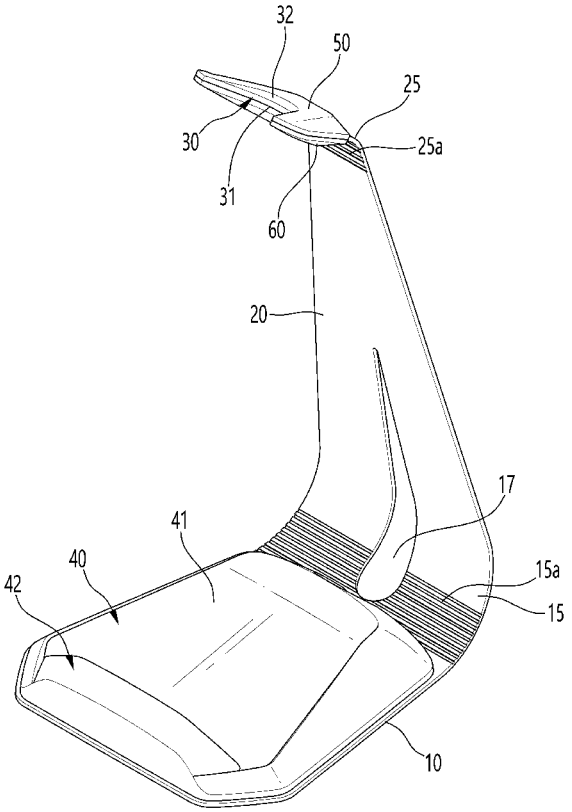
FIG. 6 is a front perspective view of a putter cradle as viewed from the front according to another embodiment of the present disclosure.

Meanwhile, as in FIG. 6, according to another embodiment of the present disclosure, a plurality of elasticity-generating grooves 15*a* may be formed on one side surface of the curved portion 15 to make the upward extension 20 move flexibly and elastically with respect to the base plate 10.

Here, the elasticity-generating grooves 15*a* have an indentation structure which is indented along a transverse direction of the curved portion 15, and the elasticity-generating grooves 15*a* may be spaced out at predetermined intervals in a vertical direction of the curved portion 15.

In addition, an auxiliary curved portion 25 rounded in an arc shape is formed at a connecting region where the upward extension 20 and the shaft holder 30 are connected.

Further, a plurality of elasticity-generating grooves 25*a* may be formed on one side surface of the auxiliary curved portion 25 to make the shaft holder 30 move flexibly and elastically with respect to the upward extension 20.

Here, the elasticity-generating grooves 25*a* also have an indentation structure which is indented along a transverse direction of the auxiliary curved portion 25, and the elasticity-generating grooves 25*a* may be spaced out at predetermined intervals in a vertical direction of the auxiliary curved portion 25.

Figure 7:
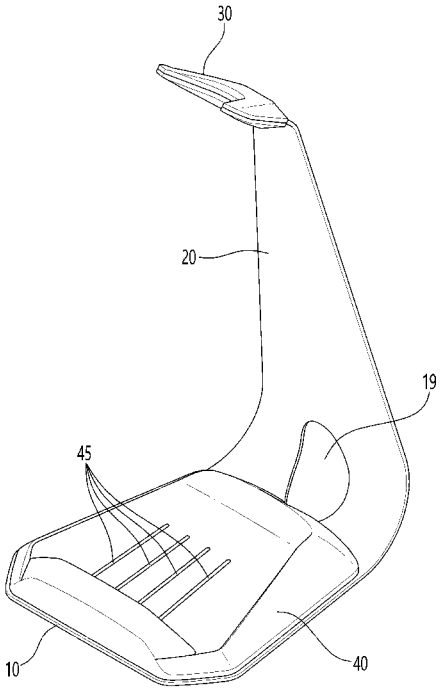
FIG. 7 is a front perspective view of a putter cradle as viewed from the front according to yet another embodiment of the present disclosure.
Figure 8:
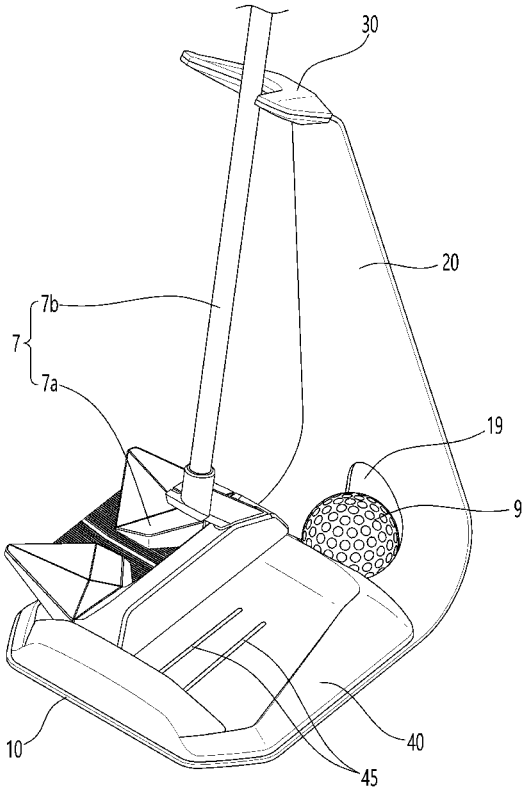
FIG. 8 is a schematic view of a putter and a golf ball held in place on a putter cradle according to a further embodiment of the present disclosure.

Meanwhile, as in FIGS. 7 and 8, according to yet another embodiment, the ball stop slit 19 where the golf ball 9 is placed has the shape of an ellipse that is bent along the curved portion 15, and a plurality of putter head mounting protrusions 45 are formed on a top side of the sloping mounting surface 41 of the head mounting pad 40, which extend longitudinally in a front-back direction of the head mounting pad 40 and protrude upward, spaced out at predetermined intervals in a width direction of the head mounting pad 40, in order to keep the golf ball 9, as well as the putter head 7*a*, from slipping off to the side of the head mounting pad 40.

An example of using a putter cradle having the above construction according to an embodiment of the present disclosure will be described below.

First, the putter cradle of the present disclosure is placed at a desired location in a practice range.

In this case, the user is able to move around while holding the cushion pad 50 and the auxiliary cushion pad 60 with hands.

Also, the user may keep their putter in the putter cradle when they take a break between putting practice rounds.

As for a process of keeping the putter in place, the putter head 7*a* is placed on the sloping mounting surface 41 of the head mounting pad 40, and then the putter shaft 7*b* is put inside the mounting groove 31 of the shaft holder 30.

Here, the putter head 7*a* slides along the slope of the sloping mounting surface 41 all the way to the slip-off prevention wall 42 and gets stuck there.

Moreover, once the golf ball 9 is placed at the ball stop slit 19 behind the head mounting pad 40, part of the outer circumference of the golf ball 9 sticks out toward the back of the curved portion 15 through the ball stop slit 19 having a through-hole structure and gets stuck, which restrains the movement of the golf ball 9, thus holding it in place.

After keeping the putter 7 and the golf ball 9 in place, the user can take a break and, after the break, can take up their putting practice again by picking up the putter 7 from where it has been secured in place.

As described above, the putter cradle according to an embodiment of the present disclosure includes a head mounting pad on a base plate, a shaft holder, and an upward extension connecting the head mounting pad and the shaft holder, so that a putter head can be mounted on the head mounting pad and a putter shaft can be set up against the shaft holder, thereby holding the putter in place and keeping the putter secure during breaks between putting practice rounds. By doing so, the putter is kept from getting damaged, and can be easily and conveniently moved to a desired location and, as a result, the putter can be secured in place in the desired location, which makes this putter cradle more competitive.

The invention claimed is:

1. A putter cradle comprising:

a base plate that attaches firmly to a ground surface, wherein a putter head of a putter is placed on a top side of the base plate;

an upward extension, one end of which is connected to one side of the base plate, and the other end of which extends at an angle toward the base plate; and a shaft holder, one end of which is connected to an upper end of the upward extension, and which has a mounting groove at the other end where a putter shaft of the putter is mounted, wherein a curved portion rounded in an arc shape is formed at a connecting region where the base plate and the upward extension are connected, and a ball stop slit is formed at one part of the curved portion, for restraining movement of a golf ball while placed thereon, wherein the ball stop slit has a through-hole structure which is bored through one side of the curved portion behind a head mounting pad so that part of the outer circumference of the golf ball is configured to jut out backward from the curved portion and be stuck in the ball stop slit.

2. The putter cradle of claim 1, wherein the head mounting pad is provided on an upper surface of the base plate, for mounting the putter head thereon, wherein a sloping mounting surface is formed on a top side of the head mounting pad, and a slip-off prevention wall is formed on one side of the head mounting pad, for preventing the putter head mounted on the mounting surface of the head mounting pad from slipping off the head mounting pad, wherein the sloping mounting surface has a sloping structure that slopes upward as the sloping mounting surface goes backward from the slip-off prevention wall toward the mounting groove.

3. The putter cradle of claim 2, wherein a plurality of putter head mounting protrusions are formed on a top side of the sloping mounting surface of the head mounting pad, which extend longitudinally in a front-back direction of the head mounting pad and protrude upward, spaced out at predetermined intervals in a width direction of the head mounting pad, in order to keep the golf ball from slipping off to the side of the head mounting pad.

4. The putter cradle of claim 2, wherein the mounting groove at a top and the slip-off prevention wall at a bottom face each other at a predetermined distance, and the mounting groove is positioned behind the slip-off prevention wall, whereby the putter shaft is tilted into place while the putter head is stuck against the slip-off prevention wall.

5. The putter cradle of claim 2, wherein a plurality of elasticity-generating grooves are formed on one side surface of the curved portion to make the upward extension elastically movable with respect to the base plate, wherein the elasticity-generating grooves have an indentation structure which is indented along a transverse direction of the curved portion, and the elasticity-generating grooves are spaced out at predetermined intervals in a vertical direction of the curved portion, and an auxiliary curved portion rounded in an arc shape is formed at a connecting region where the upward extension and the shaft holder are connected, wherein a plurality of elasticity-generating grooves are formed on one side surface of the auxiliary curved portion to make the shaft holder elastically movable with respect to the upward extension, wherein the elasticity-generating grooves of the auxiliary curved portion have an indentation structure which is indented along a transverse direction of the auxiliary curved portion, and the elasticity-generating grooves are spaced out at predetermined intervals in a vertical direction of the auxiliary curved portion.

6. The putter cradle of claim 2, wherein the slip-off prevention wall includes a sloped surface cut portion which is formed by cutting the surfaces of upper corners of a front edge of the slip-off prevention wall.

7. The putter cradle of claim 2, wherein the upward extension has a forward sloping plate structure that is tilted forward toward the slip-off prevention wall.

8. The putter cradle of claim 2, wherein the shaft holder has a sloping structure that slopes upward and forward as the shaft holder goes from bottom to top, and the mounting groove is formed on an upper end thereof.

9. The putter cradle of claim 2, wherein the mounting groove has a V-shaped structure with an entrance wider than an inner bottom portion.

* * * * *